US006551018B2

(12) United States Patent
Baker et al.

(10) Patent No.: US 6,551,018 B2
(45) Date of Patent: Apr. 22, 2003

(54) APPARATUS FOR TAMPING PAVING MATERIAL

(75) Inventors: Adrian Baker, Charleston, IL (US); Godfrey G. Little, Lerna, IL (US)

(73) Assignee: Blaw-Knox Construction Equipment Corporation, Mattoon, IL (US)

( * ) Notice: Subject to any disclaimer, the term of this patent is extended or adjusted under 35 U.S.C. 154(b) by 40 days.

(21) Appl. No.: 09/821,186

(22) Filed: Mar. 29, 2001

(65) Prior Publication Data

US 2002/0141823 A1 Oct. 3, 2002

(51) Int. Cl.[7] ..... E01C 19/34; E01C 19/22

(52) U.S. Cl. ..... 404/102; 404/118; 404/114; 404/133.05

(58) Field of Search ..... 404/102, 118, 404/116, 114, 133.05

(56) References Cited

U.S. PATENT DOCUMENTS

| | | | | |
|---|---|---|---|---|
| 1,706,121 A | | 3/1929 | Laughlin, Sr. et al. | |
| 1,780,427 A | | 11/1930 | Kirkham | |
| 2,098,895 A | | 11/1937 | Velten | |
| 2,503,560 A | | 4/1950 | Moyer | |
| 2,903,948 A | | 9/1959 | Simmonds | |
| 3,753,621 A | * | 8/1973 | Dale | 425/120 |
| 3,923,412 A | * | 12/1975 | Linz | 404/133 |
| 4,345,852 A | | 8/1982 | Goto et al. | |
| 4,493,585 A | | 1/1985 | Axer | |
| 4,828,428 A | * | 5/1989 | Anderson | 404/102 |
| 5,236,279 A | * | 8/1993 | Grinager | 404/133.05 |
| 5,516,231 A | * | 5/1996 | Heims et al. | 404/102 |
| 5,947,638 A | * | 9/1999 | Heims | 404/102 |
| 6,019,544 A | * | 2/2000 | Emerson et al. | 404/104 |
| 6,238,135 B1 | * | 5/2001 | Rower | 404/84.05 |

* cited by examiner

*Primary Examiner*—Thomas B. Will
*Assistant Examiner*—Raymond W. Addie
(74) *Attorney, Agent, or Firm*—Michael Best & Friedrich LLP

(57) ABSTRACT

An apparatus that tamps paving material and distributes the paving material evenly across a screed plate before the paving material is leveled by the screed plate. The apparatus includes a tamper bar for compacting material, a drive connected to the tamper bar, and a biasing member. The drive intermittently forces the tamper bar downward into contact with the paving material at a desired speed and to a desired depth. The biasing member is connected to the tamper bar and biases the tamper bar upward against the drive such that the biasing member raises the tamper bar out of contact with the paving surface after the drive forces the tamper bar downward.

11 Claims, 3 Drawing Sheets

APPARATUS FOR TAMPING PAVING MATERIAL

FIELD OF THE INVENTION

The invention relates to road paving machines, and more particularly to a an apparatus for tamping paving material before the paving material is leveled by a screed plate on a road paving machine.

BACKGROUND OF THE INVENTION

Road paving machines are used to deposit, spread, and compact an aggregate-filled tar-based paving material onto a prepared road bed to form a hard pavement surface. Conventional road paving machines include a heavy metal plate called a screed plate that is used to level and compress newly deposited paving material into a compact layer. A typical road paving machine also includes a tamper bar for tamping higher density paving material and distributing the paving material evenly across the screed before the paving material is leveled by the screed.

Tamper bar mechanisms usually include a drive assembly that moves at least one tamper bar into and out of engagement with the paving material to compact the paving material. The drive assembly in some known tamper bar mechanisms drives the tamper bar upward against a biasing force generated by a spring and then disengages from the tamper bar thereby allowing the biasing force of the spring and gravity to drive the tamper bar downward into contact with the paving material.

U.S. Pat. No. 4,828,428 discloses a tamper bar mechanism that includes a drive assembly which drives the tamper bar up and down such that the downward driving force acts through a spring that is coupled between the drive assembly and the tamper bar. The tamper bar is driven downward by the drive assembly until the paving material is compacted to a specific density. When the paving material is compacted to a specific density the forces generated by the drive on the tamper bar overcome the biasing force of the spring causing the spring to compress and the tamper to remain at the same vertical position against the paving material. This configuration compacts the paving material to a desired density determined by the strength of the spring coefficient, but is incapable of compacting the paving material to a desired depth.

The above described mechanisms for tamping paving material are generally effective for compressing and distributing deposited paving material before a screed plate on a road paving machine. Therefore, any improvement in the design or manufacture of such devices for tamping paving material would be desirable.

SUMMARY OF THE INVENTION

The present invention is directed to a tamper bar mechanism for tamping paving material and evenly distributing the paving material across a screed plate before the paving material is leveled by a screed plate on a road paving machine.

The tamper bar mechanism of the present invention provides an easily manufactured camshaft that intermittently drives tamper bars into contact with paving material. The camshaft includes one or more individual cams whose profiles determine (i) the speed at which tamper bars move toward the paving material, (ii) the speed at which biasing members move the tamper bars away from the paving material, and (iii) the specific depth to which the tamper bar will compact the paving material. The angular orientations of the individual cams with respect to the other cams on the shaft determine the time at which the driving force is applied to each of the tamper bars. The profiles and the angular orientations of the cams of the tamper bar mechanism are simply modified so that the driving characteristics of the plurality of tamper bars (e.g., speed, depth, timing) can be coordinated to work the paving material in front of the screed according to a desired progression.

The apparatus of the present invention includes a tamper bar for compacting material, a drive, and a biasing member. The drive intermittently forces the tamper bar downward into contact with the paving material at a desired speed and to a desired depth. The biasing member is connected to the tamper bar and biases the tamper bar upward against the drive such that the biasing member raises the tamper bar out of contact with the paving surface after the drive forces the tamper bar downward against the paving material.

In another form, the apparatus includes a plurality of tamper bars for compacting the paving material and a drive connected to the tamper bars. The drive intermittently moves each of the plurality of tamper bars into contact with the paving material at different speeds but preferably similar frequencies to compact the paving material with varying forces across the road paving machine.

The present invention also includes a method for tamping paving material before the paving material is leveled by a screed plate, the method includes: engaging a plurality of tamper bars against a drive; and driving each of the plurality of tamper bars at different speeds.

Other features and advantages of the invention will become apparent to those skilled in the art upon review of the following detailed description, claims, and drawings.

Figure 1:
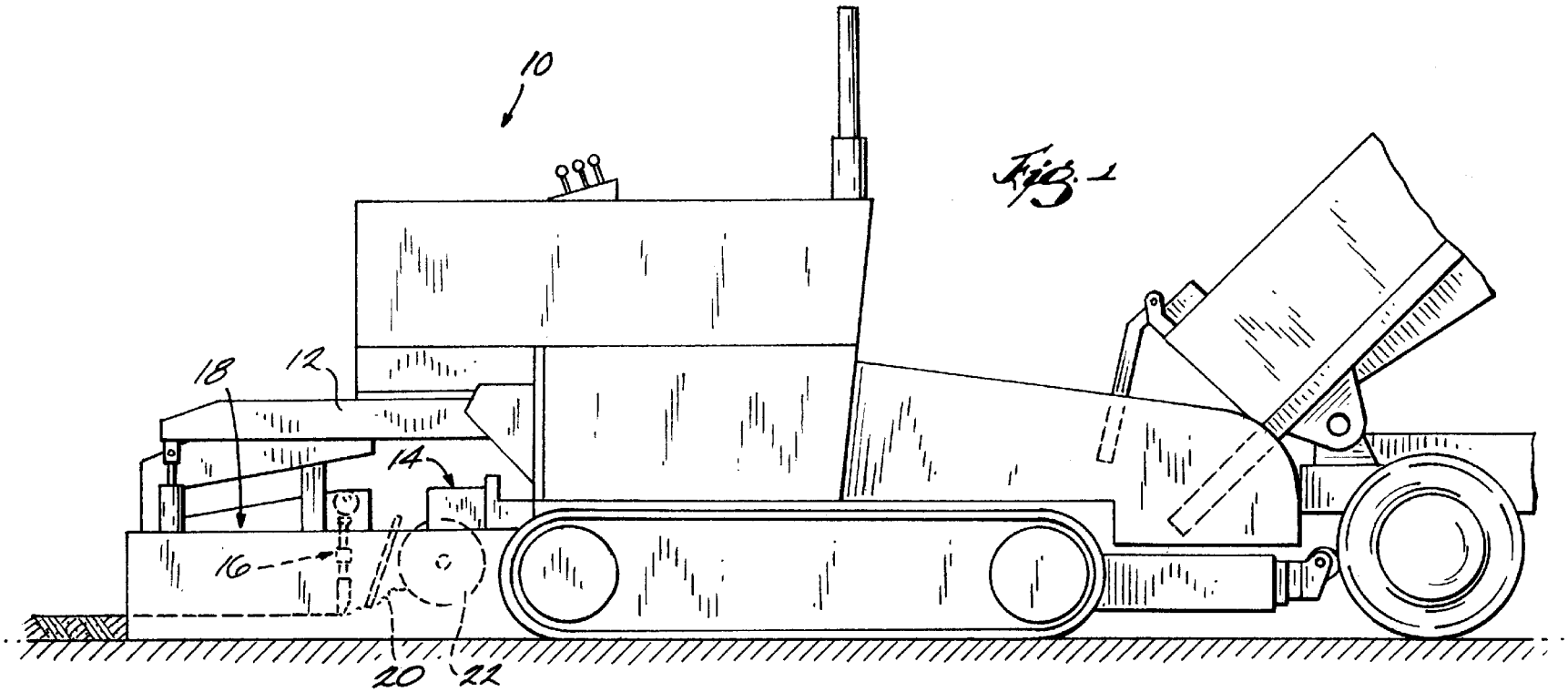
FIG. 1 is a side view illustrating a road paving machine that includes the tamper bar mechanism of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items. The use of "consisting of" and variations thereof herein is meant to encompass only the items listed thereafter. The use of letters to identify elements of a method or process is simply for identification and is not meant to indicate that the elements should be performed in a particular order.

DETAILED DESCRIPTION

FIG. 1 illustrates a road paving machine 10 that includes a frame 12, a feed system 14, a tamper bar mechanism 16 and a screed assembly 18. The feed system 14 deposits paving material 20 onto an auger 22 that is rotatably coupled to the frame 12. The feed system 14 delivers a constant volume of paving material 20 via the auger 22 to the front of the tamper bar mechanism 16. The tamper bar mechanism pre-compacts the paving material 20 as the road paving machine 10 moves forward. Finally, the screed assembly 18 compresses the paving material 20 to remove air pockets and voids in order to create a flat road surface.

Figure 2:
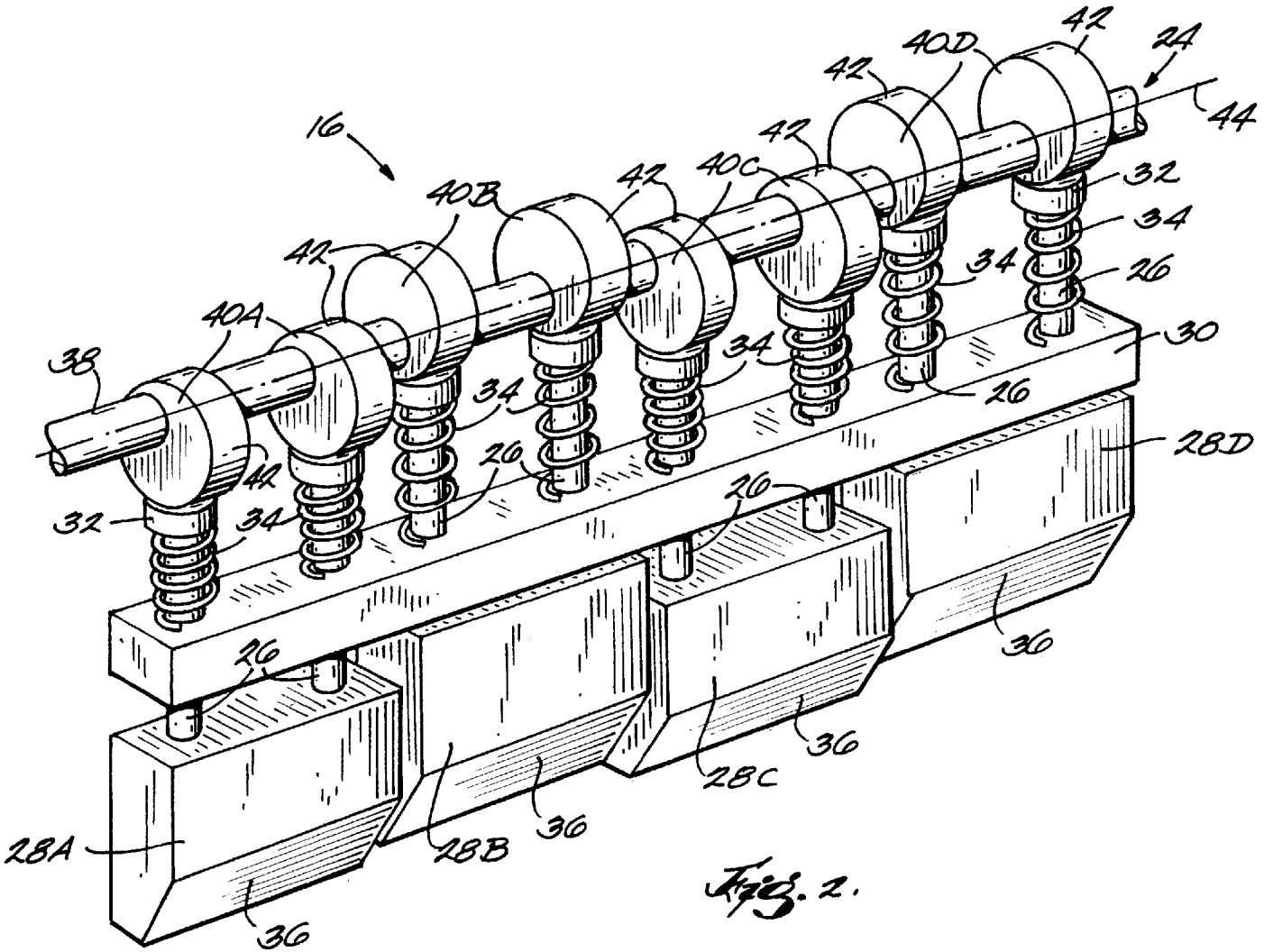
FIG. 2 is a perspective view illustrating the tamper bar mechanism of FIG. 1.

As shown in FIG. 2, the tamper bar mechanism 16 includes a camshaft 24 that is rotatably connected to the frame 12 of the road paving machine 10 and push rods 26 that are driven by the camshaft 24. Each push rod 26 is slidably connected to the frame 12 by a guide 30 and includes a head 32 that is biased into contact with the camshaft 24 by a biasing member 34. The biasing member 34 is positioned between the guide 30 and the head 32 of the push rod 26 to bias the head 32 of the push rod 26 against the camshaft 24.

The tamper bar mechanism 16 further includes tamper bars 28 that are connected to similar ends of the push rods 26 which are opposite to the heads 32 of the push rods 26. Although the illustrated embodiment discloses that each tamper bar 28 is connected to two push rods 26, each tamper bar 28 could be connected to a single push rod 26 or to more than two push rods 26 without departing from the scope of the present invention.

The tamper bar 28 is a generally rectangular plate that includes a chamfered forward edge 36. The chamfered forward edge 36 assists the flow of paving material 20 under the tamper bar 28 and the screed assembly 18. It should be noted that any size tamper bar 28 or any number of tamper bars 28 can be used with the present invention, however it is preferable to have the tamper bar mechanism 16 extend across the width of the road paving machine 10.

A motor (not shown) rotates the camshaft 24 to maneuver the tamper bars 28 downward against the biasing force generated by the biasing member 34 and to drive the tamper bars 28 against the paving material 20. After the camshaft 24 drives the tamper bar 28 downward, the biasing member 34 biases the tamper bar 28 upward away from the paving material 20 by providing an upward force against the head 32 of the push rod 26.

The camshaft 24 includes a shaft 38 and cams 40 that are attached to the shaft 38 such that the number of cams 40 corresponds with the number of push rods 26. Since the cams 40 are mounted to the same shaft 38, all of the cams 40 drive the tamper bars 28 at the same frequency. Each cam 40 includes a cam profile 42 that determines the relative acceleration and the period of time for each upward and downward stroke of the tamper bar 28. In addition, the relative angular orientation of each cam 40 determines when the cam 40 will initiate driving the tamper bar 28 downward against the paving material 20.

Figure 5:
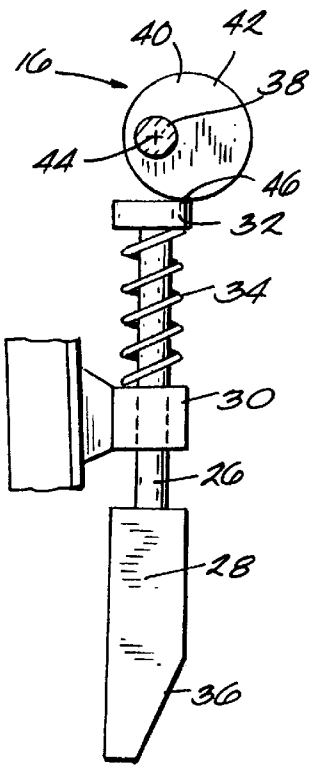
FIG. 5 is a view similar to FIG. 3 illustrating the same cam at a different angular position.
Figure 4:
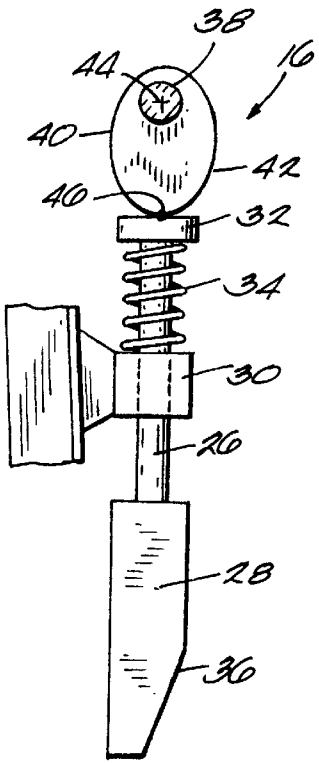
FIG. 4 is a view similar to FIG. 3 illustrating a different cam profile.
Figure 3:
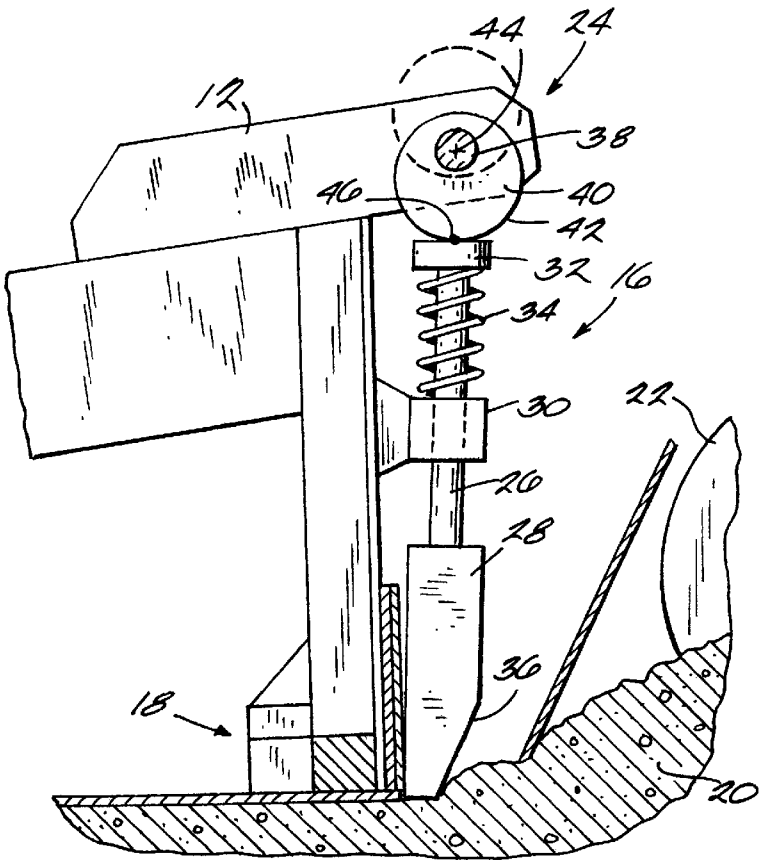
FIG. 3 is a section view taken along lines 3—3 in FIG. 2.

The cams 40 shown in FIGS. 3–5 illustrate different tamper bar 28 drive characteristics that are dependent on the configuration and orientation of the respective cams 40. The cam 40 illustrated in FIG. 3 includes a circular-shaped cam profile 42 and a 6 o'clock angular orientation relative to the shaft 38. FIG. 4 illustrates a cam 40 that includes an oval-shaped cam profile 42 at a similarly oriented 6 o'clock angular position. As an illustration, the tamper bars 28 shown in FIGS. 3 and 4 may be similarly driven by the cam 40, however the tamper bar 28 shown in FIG. 4 is accelerated downward at a faster rate compared to the tamper bar 28 shown in FIG. 3 because of the different cam profiles 42.

The cam 40 illustrated in FIG. 5 includes the same cam profile 42 as the cam 40 shown in FIG. 3, however the cam 40 of FIG. 5 includes a 3 o'clock angular orientation such that a 90 degree relative angle exists between the angular orientations of the cams 40 shown in FIGS. 3 and 5. The tamper bars 28 shown in FIGS. 3 and 5 are accelerated downward at the same rate, however when the shaft 38 is rotated clockwise the tamper bar 28 shown in FIG. 3 is driven downward before the tamper bar 28 shown in FIG. 5 because of the difference in the angular orientations.

When the camshaft 24 is rotated at a constant velocity, the cam 40 drives the tamper bar 28 downward in the same amount of time that the cam 40 allows the biasing member 34 to move the tamper bar 28 upward because it has a symmetrical cam profile 42. As shown in FIG. 5, the cam 40 drives the tamper bar 28 downward when the distance between an axis of rotation 44 and a contact point 46 increases as the camshaft 24 is rotated. The cam 40 allows the biasing member 34 to move the tamper bar 28 upward when the distance between the axis 44 and the contact point 46 decreases.

It should be noted that the cam profile 42 could alternatively be asymmetrical such that the time to execute the downward drive of the tamper bar 28 is sufficiently longer or shorter than the time taken on the upward drive of the tamper bar 28. The time for the cam 40 to drive the tamper bar 28 downward and the time for the biasing member 34 to move the tamper bar 28 upward can be varied relative to one another by modifying the cam profile 42 in order to control the distance between the axis 44 and the contact point 46 through an entire rotation of the cam 40.

The tamper bar mechanism 16 illustrated in FIG. 2 includes two sets of tamper bars 28A, 28C and 28B, 28D that are driven in an alternating fashion by cams 40A, 40C and 40B, 40D because the cams 40A, 40C and 40B, 40D are approximately 180 degrees out-of-phase relative to each other. It should be noted that any number of cams 40 in combination with any number of cam profiles 42 and angular positions may be used to create a desired progression of the tamper bars 28 without departing from the scope of the present invention.

We claim:

1. An apparatus for tamping paving material before the paving material is leveled by a screed plate, the apparatus comprising:

a tamper bar;

a rod having a lower end attached to the tamper bar and an upper end;

a cam drive including a rotatable camshaft and a cam mounted to the camshaft and slidably contactable with the upper end of the rod, the camshaft being configured to rotate the cam such that the cam slides against the rod upper end to drive the tamper bar downward against the paving material; and a biasing member coupled with the drive rod and configured to bias the rod upwardly against the cam so as to displace the tamper bar upwardly from the paving material.

2. The apparatus of claim 1, wherein the apparatus is connected with a screed assembly including a frame and the apparatus further comprises a guide member attached to the screed frame and having an opening, the rod being slidably disposed within the guide member opening.

3. The apparatus of claim 1, wherein the tamper bar includes a bottom having a tapered edge.

4. The apparatus of claim 1, wherein the profile of the cam determines the downward speed of the tamper bar.

5. The apparatus of claim 4, wherein the profile of the cam determines the upward speed of the tamper bar.

6. The apparatus of claim 1 wherein the apparatus is connected with a paving vehicle having a width and the apparatus further comprises:

a second tamper bar spaced apart from the first tamper bar along the width of the vehicle;

a second rod having a lower end attached to the second tamper bar and an upper end;

a second cam mounted on the camshaft, the second cam being slidably contactable with the second rod upper end so as to drive the second tamper bar downward against the paving material; and a second biasing member connected to the second tamper bar for biasing the tamper bar upward against the second cam.

7. The apparatus of claim 6, wherein the speed of the second tamper bar generated by the second cam is different from the speed of the first tamper bar generated by the first cam.

8. An apparatus for tamping paving material and distributing the paving material evenly across a screed plate before the paving material is leveled by the screed plate, the apparatus comprising:

a tamper bar for compacting the paving material;

a drive connected to the tamper bar for driving the tamper bar downward into contact with the paving material; and a biasing member connected to the tamper bar for biasing the tamper bar upward against the drive such that the biasing member raises the tamper bar out of contact with the paving surface when the drive is not driving the tamper bar downward.

9. An apparatus for tamping paving material before the paving material is leveled by a screed plate, the apparatus comprising:

a tamper bar;

a drive including a camshaft having a drive shaft and a cam mounted to the drive shaft such that rotation of the camshaft drives the tamper bar, the cam engaging the tamper bar and having a configuration that determines the upward and downward speed of the tamper bar;

a push rod coupled to the tamper bar and engaged with the drive for transmitting a driving force to the tamper bar from the drive;

a push rod guide slidingly engaged with the push rod; and a biasing member engaged with the tamper bar and the push rod guide for biasing the tamper bar upward against the drive.

10. A tamping apparatus for a screed assembly used with a paving vehicle, the vehicle having a width and the screed assembly including a screed plate for leveling paving material, the apparatus comprising:

a plurality of tamper bars located forwardly of the screed plate and spaced apart along an axis extending generally across the width of the paving vehicle;

a drive including a drive shaft and a plurality of cams mounted to the drive shaft, each of the plurality of cams being connected to a corresponding one of the plurality of tamper bars, and having different profiles for driving each of the plurality of tamper bars at different speeds, wherein each of the plurality of tamper bars are driven downward at the same frequency; and a plurality of biasing members such that each of the biasing members is coupled with a corresponding one of the plurality of tamper bars to bias the plurality of tamper bars upward against the drive.

11. The apparatus of claim 10, wherein each of the plurality of cams is positioned at different angular orientations about the shaft with respect to another one of the plurality of cams for driving each of the plurality of tamper bars downward at different times.

* * * * *